US005821687A

United States Patent [19]

Miyazaki et al.

[11] Patent Number: 5,821,687

[45] Date of Patent: Oct. 13, 1998

[54] METHOD FOR FORMULATING THREE-WAVELENGTH FLUORESCENT MATERIAL AND THREE-WAVELENGTH FLUORESCENT LAMP-USING FLUORESCENT MATERIAL PRODUCED BY THE SAME

[75] Inventors: Hirohisa Miyazaki; Masafumi Mizuno, both of Iwaki, Japan

[73] Assignee: Stanley Electric Co., Ltd., Tokyo, Japan

[21] Appl. No.: 797,488

[22] Filed: Feb. 7, 1997

[30] Foreign Application Priority Data

Feb. 9, 1996 [JP] Japan ..... 8-046898

[51] Int. Cl.[6] ..... H01J 1/62

[52] U.S. Cl. ..... 313/486; 313/487

[58] Field of Search ..... 313/485, 486, 313/487; 252/301.4 F, 301.4 H, 301.4 P

[56] References Cited

U.S. PATENT DOCUMENTS

| | | | |
|---|---|---|---|
| 4,940,918 | 7/1990 | Rutfield | 313/487 |
| 5,028,839 | 7/1991 | Abeywickrama et al. | 313/486 |
| 5,049,779 | 9/1991 | Itsuski et al. | 313/486 |

FOREIGN PATENT DOCUMENTS

| | | |
|---|---|---|
| 0364124 | 4/1990 | European Pat. Off. . |
| 0550956 | 7/1993 | European Pat. Off. . |
| 2435813 | 4/1980 | France . |
| 5028966 | 2/1993 | Japan . |

OTHER PUBLICATIONS

Specification No. NP–105–02 by Michia Kagaku Kogyo Kabushiki Kaisha, Date of Preparation: Nov. 11, 1996.
Specification No. NP–220–02 by Michia Kagaku Kogyo Kabushiki Kaisha, Date of Publication: Nov. 11, 1996.
Specification No. NP–340–01 by Michia Kagaku Kogyo Kabushiki Kaisha, Date of Publication: Nov. 11, 1996.
Specification No. NP–103–04 by Michia Kagaku Kogyo Kabushiki Kaisha, Date of Publication: Nov. 11, 1996.
Specification No. NP–220–42 by Michia Kagaku Kogyo Kabushiki Kaisha, Date of Publication: Nov. 11, 1996.

*Primary Examiner*—Sandra L. O'Shea
*Assistant Examiner*—Vip Patel
*Attorney, Agent, or Firm*—Weingarten, Schurgin, Gagnebin & Hayes LLP

[57] ABSTRACT

There is provided a method for formulating a three-wavelength fluorescent material 2 in which a blue fluorescent material B2 has a half-width value of 25 to 40 nm, a green fluorescent material has a particle diameter of 4.0 to 8.0 $\mu$m, and the blue florescent material B2/green fluorescent material G2/red fluorescent material R1 mixing ratio is 29.2:42.0:28.8. The present invention makes it possible to improve the brightness of a three-wavelength florescent lamp 1 using this three-wavelength fluorescent material 2 by substantially 13% and the flux of light thereof by substantially 4%, thus realizing a brighter three-wavelength fluorescent lamp.

2 Claims, 2 Drawing Sheets

METHOD FOR FORMULATING THREE-WAVELENGTH FLUORESCENT MATERIAL AND THREE-WAVELENGTH FLUORESCENT LAMP-USING FLUORESCENT MATERIAL PRODUCED BY THE SAME

BACKGROUND OF THE INVENTION

1. Field of the Invention

This invention relates to a fluorescent lamp so called "natural color fluorescent lamp" using a three-wavelength fluorescent material to improve a color rendition property and to a formulating method for obtaining the three-wavelength fluorescent material.

2. Background Art

This type of three-wavelength fluorescent material 91 of the prior art employs $(SrCaBa)_5(Po_4)_3Cl$ having a particle diameter of around 6.0 $\mu$m and a half-width value of around 43 nm (manufactured by Nichia Kagaku: Article No. NP-105) as a blue fluorescent material B1, $Zn_2SiO_4$ having a particle diameter of around 4.8 $\mu$m (manufactured by Nichia Kagaku: Article- No. NP-200) as a green fluorescent material G1 and $Y_2O_3$ having a particle diameter of around 5.9 $\mu$m (manufactured by Nichia Kagaku: Article No. NP-340) as a red fluorescent material R1 in a B1/G1/R1 mixing ratio (weight ratio) of 37.2:37.2:25.6%.

For the production of a three-wavelength fluorescent lamp 90, the three-wavelength fluorescent material 91 prepared by blending the above materials is applied to the interior surface of a bulb 92 as shown in FIG. 4 to cause light emission having well-balanced three primary colors of light, thereby improving the color rendition property of the three-wavelength fluorescent lamp 90 from which a strong bluish tint, the characteristic of this type of electric discharge lamp, cannot be seen.

In the above-mentioned three-wavelength fluorescent material 91 of the prior art, since the half-width value of the blue fluorescent material B1 is large, firstly, luminous efficacy at the pure blue color range of 430 to 460 nm is low with the result that the blending proportion of the blue fluorescent material B1 in the three-wavelength fluorescent material 91 is large.

Secondly, when the blending proportion of the blue fluorescent material B1 increases for the above reason, the wavelength range of light emitted from the blue fluorescent material B1 includes the wavelength range of light emitted from the green fluorescent material G1 because the half-width value of the blue fluorescent material B1 is large. Therefore, if the blending proportion of the green fluorescent material G1 is not reduced, the balance among three primary colors will be lost and a greenish tint will be strong, thereby deteriorating a color rendition property.

However, a reduction in the blending proportion of the green fluorescent material G1 in the above-mentioned three-wavelength fluorescent material 91 of the prior art results in a reduction in the emission wavelength of around 540 nm at which human relative visibility becomes the highest. Therefore, the three-wavelength fluorescent lamp which is produced using this three-wavelength fluorescent material 91 involves such a problem that its luminous efficacy is low perceptively and in terms of measurement value so that a user feels it dark. The above-mentioned green fluorescent material G1 having a smaller diameter than the blue fluorescent material B1 and the red fluorescent material R1 is used from a view point of production costs as described above with the result that its luminous efficacy lowers, making more serious the above problem that a user feels it dark.

Furthermore, since the above-mentioned blue fluorescent material B1 deteriorates faster than the green fluorescent material G1 and the red fluorescent material R1 while light is emitted, an increase in the blending proportion of the blue fluorescent material B1 accelerates a reduction in brightness when the fluorescent lamp 90 is kept on with the result that the service life of the fluorescent lamp 90 is shortened. Solutions to these problems have been awaited.

SUMMARY OF THE INVENTION

The present invention provides, as means for solving the above problems of the prior art, a method for formulating a three-wavelength fluorescent material by mixing a blue fluorescent material, a green fluorescent material and a red fluorescent material in a suitable ratio, wherein the green fluorescent material has a half-width value of 25 to 40 nm, the green fluorescent material has a particle diameter of 4.0 to 8.0 $\mu$m, and the blue fluorescent material/green fluorescent material/red fluorescent material mixing ratio is 29.2:42.0:28.8.

DETAILED DESCRIPTION OF THE PREFERRED EMBODIMENTS

Figure 1:
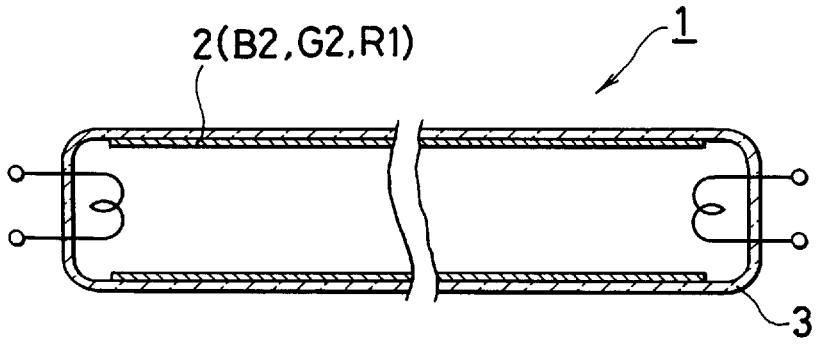
FIG. 1 is a sectional view of a three-wavelength fluorescent lamp according to an embodiment of the present invention.

The present invention is described in detail with reference to a preferred embodiment shown in the accompanying drawings. In FIG. 1, reference numeral 1 denotes a three-wavelength fluorescent lamp. In this three-wavelength fluorescent lamp 1, a three-wavelength fluorescent material 2 prepared by formulating a blue fluorescent material B2, a green fluorescent material G2 and a red florescent material R1 in a predetermined ratio by a formulating method of the present invention to be described below is applied to the interior surface of a bulb 3. While a hot-cathode three-wavelength fluorescent lamp 1 is shown in the figure, when it is a cold-cathode three-wavelength fluorescent lamp, the present invention can be carried out likewise.

Figure 2:
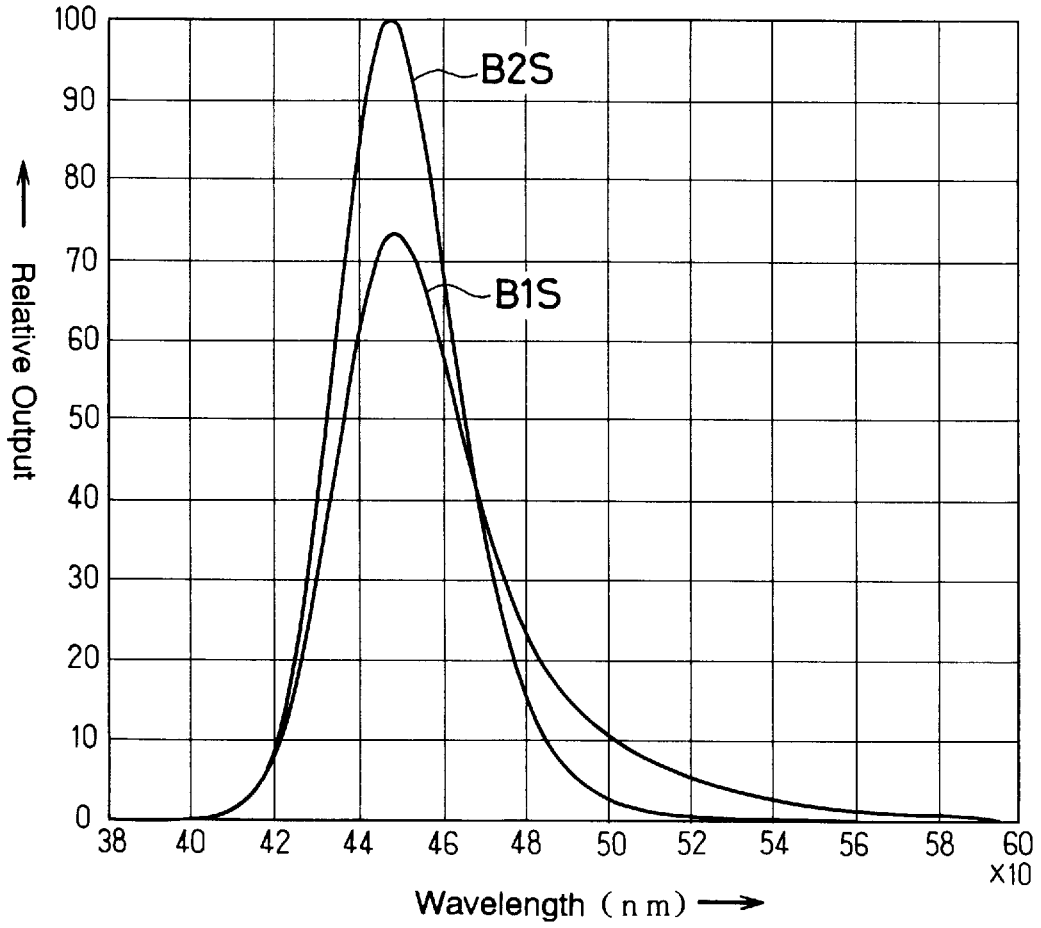
FIG. 2 is a graph showing comparison between the blue light spectrum curve of a blue fluorescent material used in the method for formulating a three-wavelength fluorescent material according to the present invention and that of the prior art.

In FIG. 2, reference symbol B2S denotes the blue light spectrum curve of a blue fluorescent material B2 (manufactured by Nichia Kagaku: Article No. NP103-04) used in the present invention. Compared with the blue light spectrum curve B1S of the blue fluorescent material B1 of the prior art shown in the figure, the efficacy of blue light emission of substantially 450 nm is improved by substantially 30% when the half-width value is 25 to 40 nm, preferably 30 to 35 nm.

In the present invention, what has a particle diameter of 4.0 to 8.0 $\mu$m, preferably 4.5 to 5.5 $\mu$m (manufactured by Nichia Kagaku: Article No. NP220-42) is used as the green fluorescent material G2 to improve the luminous efficacy thereof. As for the red fluorescent material G1, the same material (manufactured by Nichia Kagaku: Article No. NP-340) as in the prior art is used.

To obtain a predetermined color temperature (for example, 6,500K°) from an increase in the efficacy of blue light emission from the above blue fluorescent material B2, it is necessary to increase the blending proportions of the green fluorescent material G2 and the red fluorescent material R1. In the three-wavelength fluorescent material 2 of the present invention, the blue fluorescent material B2/green fluorescent material G2/red fluorescent material R1 blending ratio is 29.2:42.0:28.8% (weight ratio).

When the function and effect of the three-wavelength fluorescent material 2 of the present invention constituted above is described, an increase in the blending proportion of the green fluorescent material G2, in particular, is extremely effective in improving brightness because the wavelength (530 to 560 nm) of light emitted from the green fluorescent material G2 coincides with a wavelength at which human visibility becomes the highest.

Moreover, the effect of improving luminous efficacy by increasing the particle diameter of the green fluorescent material G2 is added as described above. As a result, a substantially 13% increase in brightness from 17,100 nt to 19,340 nt and a substantially 4% increase in the flux of light from 20.1 lm to 20.9 lm are achieved in this embodiment.

Figure 3:
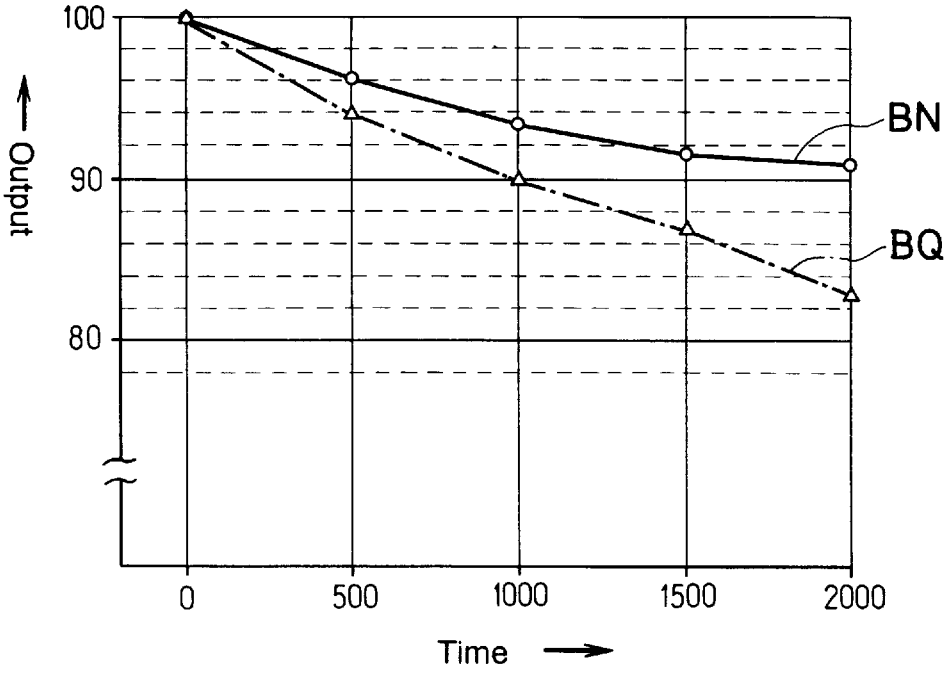
FIG. 3 is a graph showing comparison between the time-brightness curve of a three-wavelength fluorescent lamp according to the present invention and that of the prior art.
Figure 4:
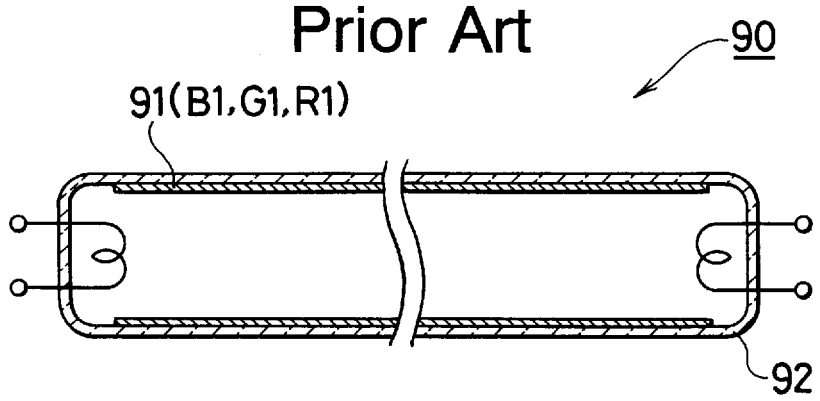
Fig.4 Prior Art
FIG. 4 is a sectional view of a three-wavelength fluorescent lamp of the prior art.

Increases in the blending proportions of the green fluorescent material G2 and the red fluorescent material R1 result in a reduction in the blending proportion of the blue fluorescent material B2 whose brightness deteriorates the fastest in the entire configuration of the three-wavelength fluorescent material 2 when the three-wavelength fluorescent lamp is kept on. Therefore, thee service life of the three-wavelength fluorescent lamp 1 can be extended and the brightness retaining rate when the lamp is kept on for 2,000 hours is 91% in this embodiment as shown in the time-brightness curve BN of FIG. 3, which is a substantially 8% increase from 83% of the time-brightness curve BQ of the prior art.

As described on the foregoing pages, the present invention provides a method for formulating a three-wavelength fluorescent material in which the blue fluorescent material has a half-width value of 25 to 40 nm, the green fluorescent material has a particle diameter of 4.0 to 8.0 nm and the blue fluorescent material/green fluorescent material/red fluorescent material mixing ratio is 29.2:42.0:28.8. Therefore, the present invention makes it possible to improve the brightness of a three-wavelength florescent lamp using this three-wavelength fluorescent material by substantially 13% and the flux of light thereof by substantially 4%, thus realizing a brighter three-wavelength fluorescent lamp with the same power consumption. In addition, the above configuration makes it possible to reduce the amount of the blue fluorescent material used which deteriorates the most in brightness with the result of a substantially 8% increase in the brightness retaining rate, thereby making it possible to extend the service life of the lamp. Consequently, the present invention has an extremely excellent effect of improving the performance of this type of three-wavelength fluorescent lamp.

What is claimed is:

1. A three-wavelength fluorescent lamp in which a three-wavelength fluorescent material formulated by mixing a blue fluorescent material, a green fluorescent material and a red fluorescent material in a suitable ratio is applied to the interior surface of a bulb, wherein, in the three-wavelength fluorescent material, said blue fluorescent material has a half-width value of 25 to 40 nm, said green fluorescent material has a particle diameter of 4.0 to 8.0 $\mu$m, and mixing ratio of the blue fluorescent material:green fluorescent material:red fluorescent material is 29.2:42.0:28.8.

2. A method for formulating a three-wavelength fluorescent material by mixing a blue fluorescent material, a green fluorescent material and a red fluorescent material in a suitable ratio, wherein said blue fluorescent material has a half-width value of 25 to 40 nm, said green fluorescent material has a particle diameter of 4.0 to 8.0 $\mu$m, and mixing ratio of the blue fluorescent material:green fluorescent material:red fluorescent material is 29.2:42.0:28.8.

* * * * *